US009115484B2

(12) United States Patent
Fulford et al.

(10) Patent No.: US 9,115,484 B2
(45) Date of Patent: Aug. 25, 2015

(54) MAGNETIC ACCESSORY ATTACHMENT DEVICE FOR SINK

(75) Inventors: Evan Allen Fulford, Chicago, IL (US); Daniel Keating Childs, Chicago, IL (US)

(73) Assignee: Elkay Manufacturing Company, Oak Brook, IL (US)

( * ) Notice: Subject to any disclaimer, the term of this patent is extended or adjusted under 35 U.S.C. 154(b) by 758 days.

(21) Appl. No.: 13/427,514

(22) Filed: Mar. 22, 2012

(65) Prior Publication Data

US 2012/0240330 A1 Sep. 27, 2012

Related U.S. Application Data

(60) Provisional application No. 61/467,828, filed on Mar. 25, 2011.

(51) Int. Cl.
*E03C 1/244* (2006.01)
*E03C 1/186* (2006.01)

(52) U.S. Cl.
CPC ..... *E03C 1/186* (2013.01); *E03C 1/244* (2013.01); *Y10T 29/49826* (2015.01)

(58) Field of Classification Search
CPC ..... E03C 1/186
USPC ..... 4/619–660
See application file for complete search history.

(56) References Cited

U.S. PATENT DOCUMENTS

| | | | |
|---|---|---|---|
| 428,783 | A | 5/1890 | Reubel et al. |
| 502,654 | A | 8/1893 | Brothwell et al. |
| 502,659 | A | 8/1893 | Day |
| 584,380 | A | 6/1897 | Loveless |
| 924,248 | A | 6/1909 | Lazear |
| 1,229,874 | A | 6/1917 | Boye |
| 1,391,599 | A | 9/1921 | Wood |
| 1,403,333 | A | 1/1922 | McGhee |
| 1,424,337 | A | 8/1922 | Boye |
| 1,453,748 | A | 5/1923 | Carlson |
| 1,504,825 | A | 8/1924 | Larsen |
| 2,212,326 | A | 8/1940 | Piken |
| 2,617,537 | A | 11/1952 | Henley |
| 2,637,446 | A | 5/1953 | Spangler |
| 2,639,930 | A | 5/1953 | Thornton |
| 2,977,082 | A | 3/1961 | Harris |
| 3,000,016 | A | 9/1961 | Ridge |

(Continued)

FOREIGN PATENT DOCUMENTS

| | | | |
|---|---|---|---|
| CA | 2 289 996 | * | 5/2001 |
| CA | 2 289 996 A1 | | 5/2001 |

(Continued)

*Primary Examiner* — Lori Baker
(74) *Attorney, Agent, or Firm* — Leydig, Voit & Mayer Ltd.

(57) ABSTRACT

A magnetic accessory attachment device for a sink that provides the ability to utilize a device to attach any one of an assorted set of accessories to the sidewalls, rim, or base of a sink. The magnetic accessory attachment device can have a magnet disposed within a body. The accessory can have a ferromagnetic material that is attracted to the magnet when brought into proximity with the magnetic accessory attachment device. Examples of suitable accessories include a cup, drain stopper, hook, small shelf, sponge holder, etc. The sink can also include a ferromagnetic material that is attracted to the magnet when brought into proximity with the magnetic accessory attachment device.

18 Claims, 22 Drawing Sheets

(56) References Cited

U.S. PATENT DOCUMENTS

| | | | | |
|---|---|---|---|---|
| 3,020,562 | A | 2/1962 | Reynolds | |
| 3,023,991 | A | 3/1962 | Fisher | |
| 3,034,140 | A | 5/1962 | Reynolds | |
| 3,107,361 | A | 10/1963 | Glutting, Sr. | |
| 3,169,743 | A | 2/1965 | Page, Jr. | |
| 3,382,507 | A | 5/1968 | Micheau | |
| 3,642,122 | A | 2/1972 | Von Ende | |
| 3,782,799 | A | 1/1974 | Hansen | |
| 3,827,020 | A | 7/1974 | Okamoto | |
| 4,465,198 | A | 8/1984 | Martin | |
| 4,678,150 | A | 7/1987 | Newman et al. | |
| 4,884,714 | A | 12/1989 | Bechtel | |
| 5,217,123 | A | 6/1993 | Riley et al. | |
| 5,367,278 | A | 11/1994 | Yoshikawa | |
| 5,746,329 | A | 5/1998 | Rondeau | |
| 6,338,171 | B1 | 1/2002 | Dandridge | |
| 6,502,794 | B1 | 1/2003 | Ting | |
| 6,688,479 | B2 | 2/2004 | Nei | |
| 7,243,806 | B2 | 7/2007 | Kwok | |
| 2002/0088909 | A1 | 7/2002 | Chen | |
| 2005/0156085 | A1 | 7/2005 | Radovan | |
| 2006/0026748 | A1 | 2/2006 | Kwok | |
| 2006/0201894 | A1 * | 9/2006 | Wood et al. | 211/10 |
| 2007/0040081 | A1 | 2/2007 | Dietz | |
| 2008/0210835 | A1 | 9/2008 | Bagnall | |
| 2009/0211017 | A1 | 8/2009 | Bowden et al. | |
| 2009/0314730 | A1 | 12/2009 | Mansikkamaa | |
| 2010/0072147 | A1 | 3/2010 | Reenberg et al. | |
| 2010/0148896 | A1 | 6/2010 | Hugo | |
| 2010/0275367 | A1 | 11/2010 | Bager et al. | |
| 2015/0012058 | A1 * | 1/2015 | Crawford et al. | 607/57 |

FOREIGN PATENT DOCUMENTS

| | | | |
|---|---|---|---|
| DE | 201 01 822 | U1 | 5/2001 |
| DE | 20 2004 006 864 | U1 | 8/2004 |
| DE | 20 2004 016 497 | U1 | 12/2004 |
| DE | 10 2008 049 794 | A1 | 9/2008 |
| DE | 10 2008 049 794 | * | 4/2010 |
| JP | 07213444 | A | 8/1995 |
| JP | 08068089 | A | 3/1996 |
| JP | 09313366 | A | 12/1997 |
| JP | 10243888 | A | 9/1998 |
| JP | 10295607 | A | 11/1998 |
| JP | 2002315681 | A | 10/2002 |
| JP | 2006116256 | A | 5/2006 |
| JP | 2006141491 | A | 6/2006 |
| JP | 2007068828 | A | 12/2007 |
| WO | WO 2007/144450 | A1 | 12/2007 |

* cited by examiner

MAGNETIC ACCESSORY ATTACHMENT DEVICE FOR SINK

CROSS-REFERENCE TO RELATED APPLICATIONS

This patent application claims the benefit of U.S. Provisional Patent Application No. 61/467,828, filed Mar. 25, 2011, which is incorporated by reference in its entirety herein.

BACKGROUND

When performing tasks involving sinks, it is common to have a number of items such as soap, rags, drain stoppers, etc. located in and around the sink. Typically, these items are rested in an unorganized manner on the counter supporting the sink, the sink rim, or in the sink basin, which is not convenient for a user. Moreover, placing dirty items on areas outside of the sink is aesthetically displeasing and can soil these areas.

BRIEF SUMMARY

A magnetic accessory attachment device for a sink is described herein that provides the ability to utilize a device to attach any one of an assorted number of accessories to the sidewalls, rim, or base of a sink.

A magnetic accessory attachment device is described for attaching an accessory having a non-magnetized ferromagnetic material to a sink having a non-magnetized ferromagnetic material. The magnetic accessory attachment device can have a body and a magnet. The body can have a first external surface and a second external surface. At least one of the first and second external surfaces can be adapted to contact the sink, and at least one of the first and second external surfaces can be adapted to contact the accessory. The magnet can be disposed within the body such that when the body is placed near the non-magnetized ferromagnetic material of the accessory, the magnet draws at least one of the first and second external surfaces against the accessory to removeably attach the magnetic accessory attachment device to the accessory. Likewise, the magnet can be disposed within the body such that when the body is disposed near the non-magnetized ferromagnetic material of the sink, the magnet draws the other of the at least one of the first and second external surfaces against the sink to removeably attach the magnetic accessory attachment device to the sink.

A method of attaching an accessory having a non-magnetized ferromagnetic material to a sink having a non-magnetized ferromagnetic material is also described. The method can include providing a magnetic accessory attachment device having a body and magnetic properties, placing the magnetic accessory attachment device in proximity to the non-magnetized ferromagnetic material of the accessory such that the magnetic accessory attachment device is removeably attached to the accessory, and placing the magnetic accessory attachment device in proximity to the non-magnetized ferromagnetic material of the sink such that the magnetic accessory attachment device is removeably attached to the sink.

DETAILED DESCRIPTION

Figure 1:
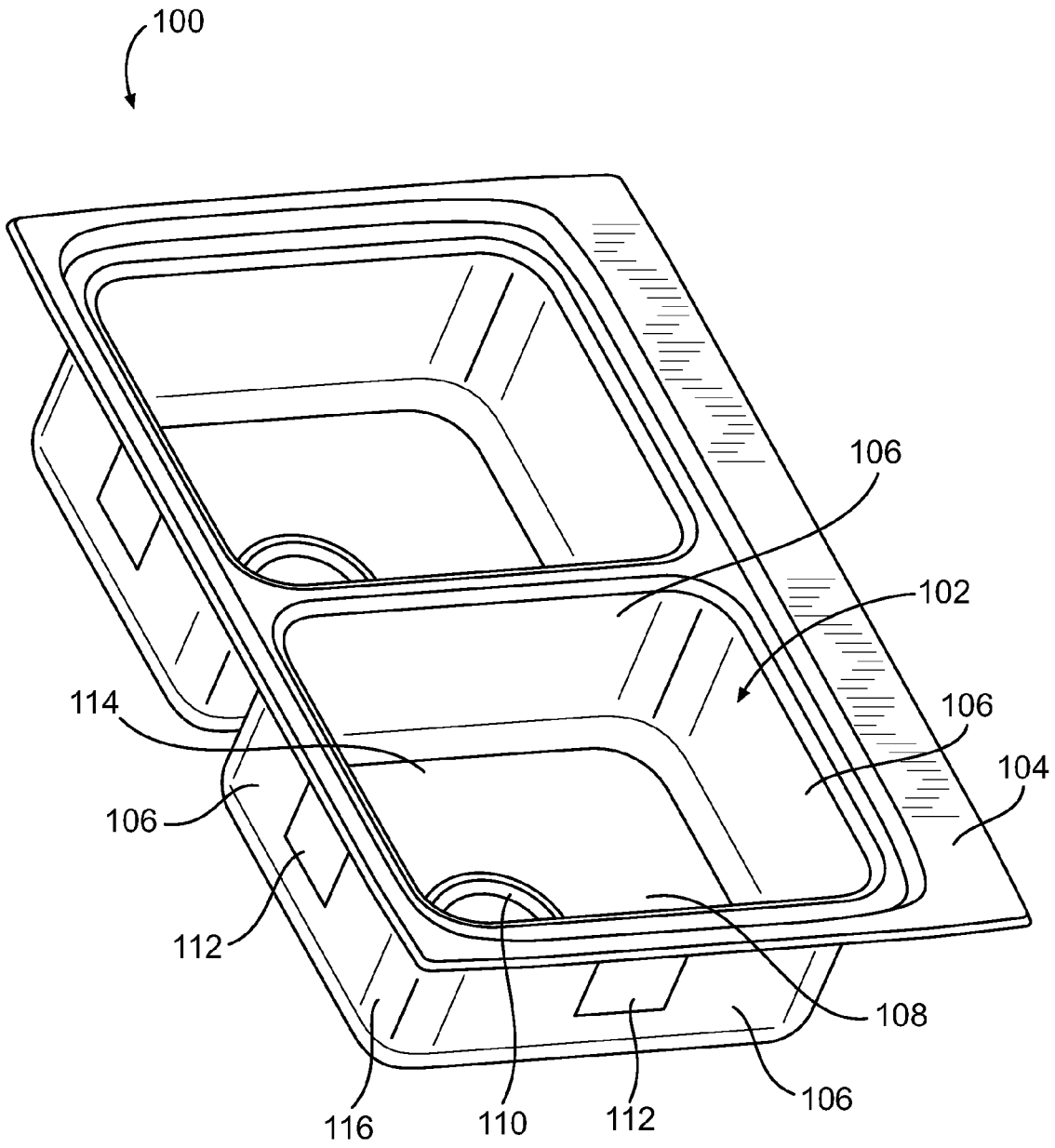
FIG. 1 is a perspective view of a sink.
Figure 2:
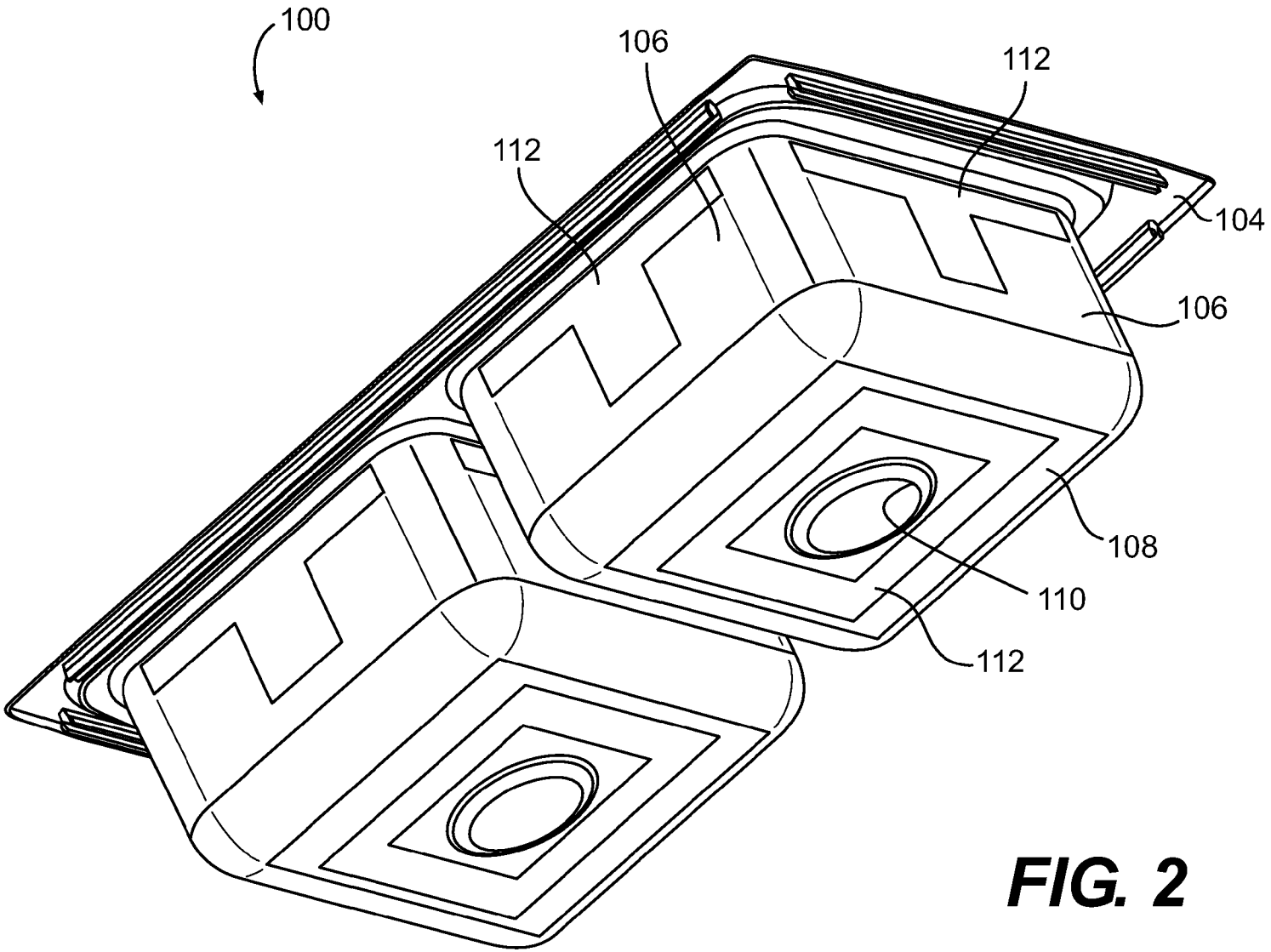
FIG. 2 is another perspective view of the sink of FIG. 1.
Figure 3:
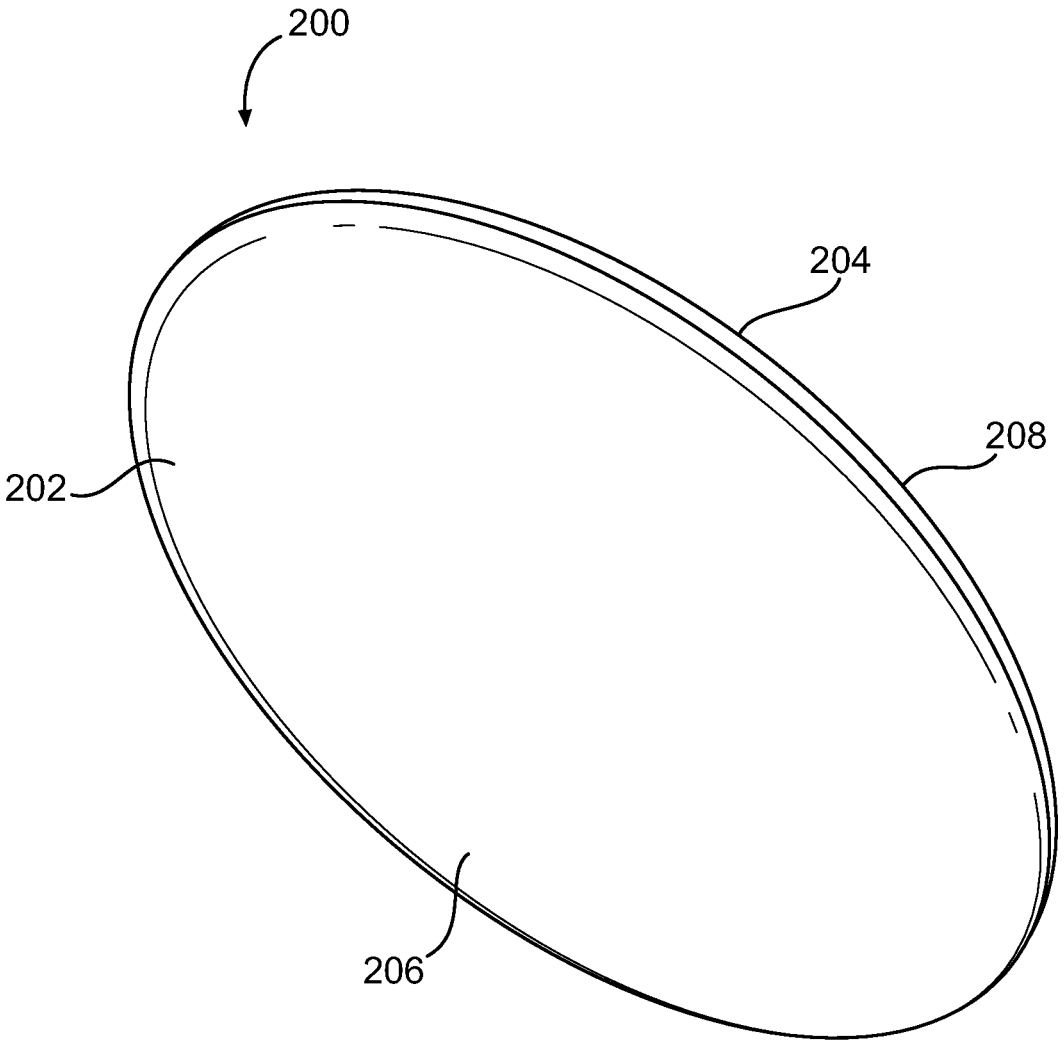
FIG. 3 is a perspective view of a magnetic accessory attachment device suitable for use with the sink of FIG. 1.
Figure 4:
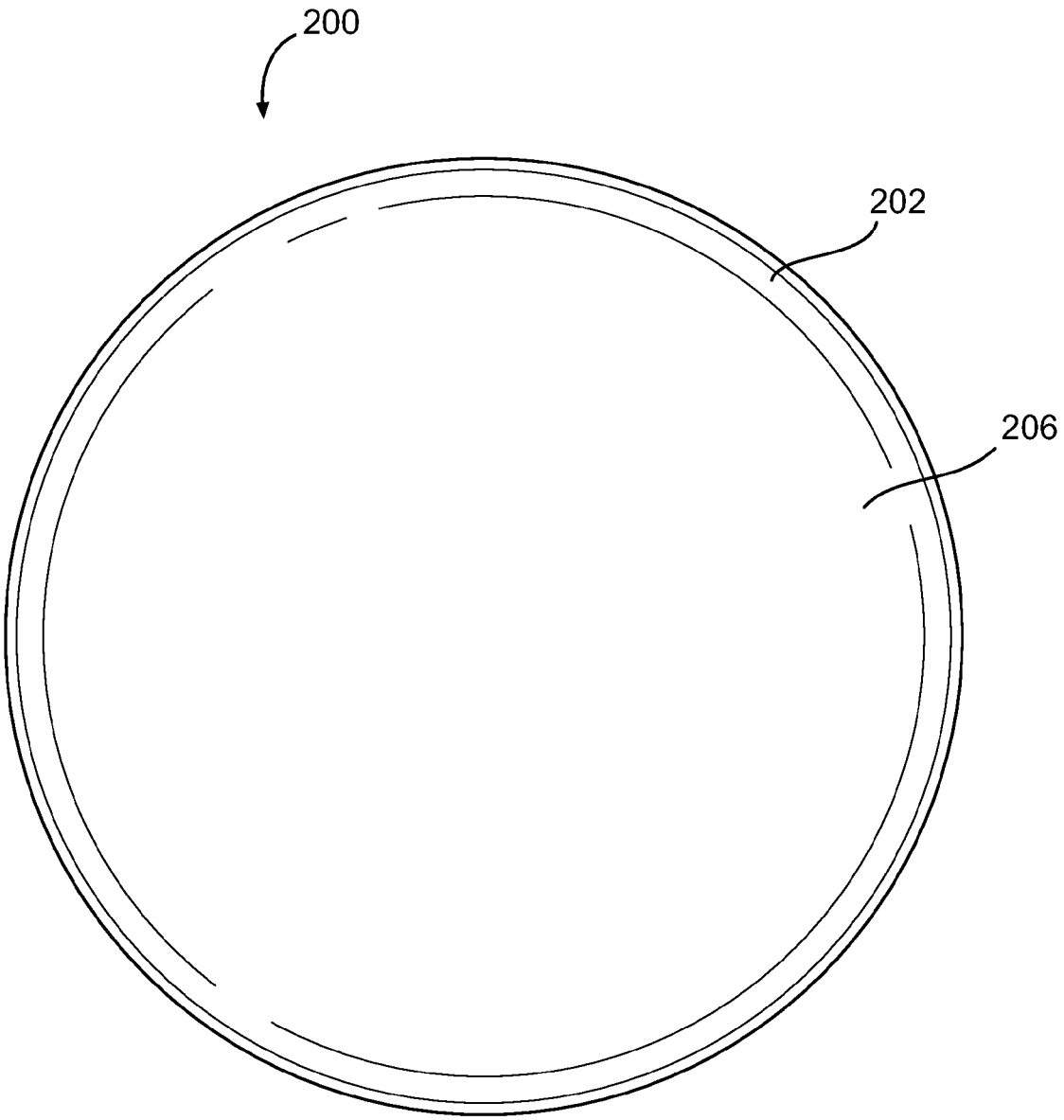
FIG. 4 is a front plan view of the magnetic accessory attachment device of FIG. 3.
Figure 5:
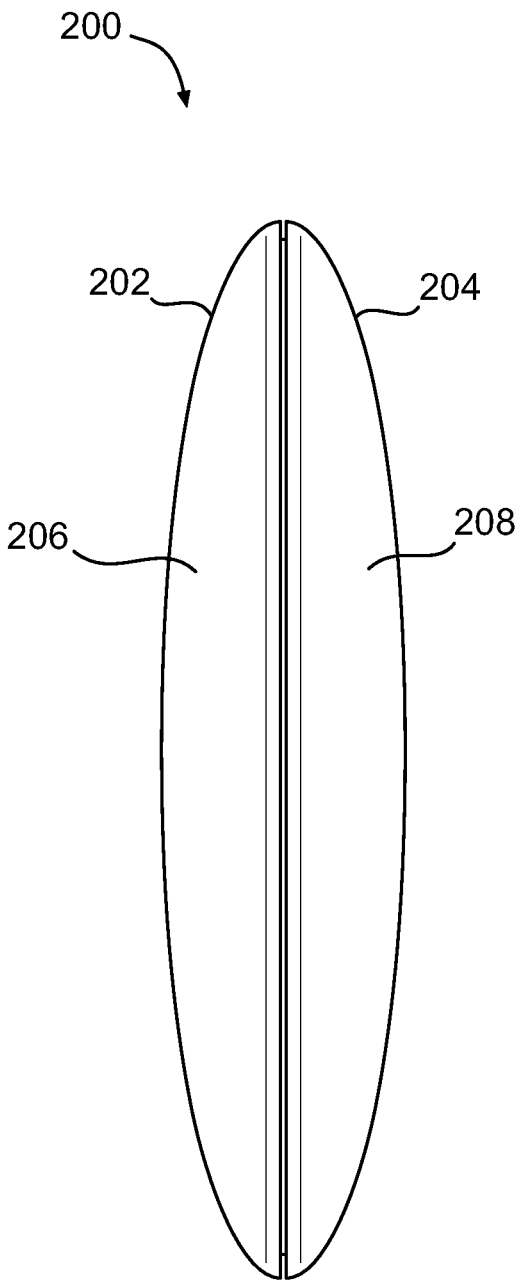
FIG. 5 is a side view of the magnetic accessory attachment device of FIG. 3.

Referring to FIGS. 1 and 2, a sink 100 for use with a magnetic accessory attachment device is shown. The sink 100 can include one or more sink basins 102 and a rim 104. Each sink basin 102 can include one or more sidewalls 106 and a base 108. The base 108 can include an opening 110 for a drain. The sidewalls 106 and base 108 can form an interior surface 114 of the basin 102 to retain water and washable items. The sidewalls 106 and base 108 can also form an exterior surface 116 of the basin 102. The rim 104 can be used to support the basin 102 in an above-mount arrangement or under-mount arrangement with respect to a counter.

In certain embodiments, the sink 100 can be constructed of a non-magnetized ferromagnetic material such that a magnet can be attached directly to a surface of the sink 100. In other embodiments, such as nonferromagnetic stainless steel sinks, a non-magnetized ferromagnetic material can be attached to the sink 100 to attract a magnet to the sink. As shown in FIGS. 1 and 2, one or more non-magnetized ferromagnetic materials 112 can be adhered to the exterior surface 116 of the sink basin 102. The ferromagnetic materials 112 can be adhered to the exterior surface 116 near one or more of the sidewalls 106 and bases 108 of the sink basin 102. The ferromagnetic material 112 can be any suitable material of any suitable shape and size. In addition, any suitable number of ferromagnetic materials may be disposed in any suitable positions on the sink basin 102 or rim 104, and in some embodiments, the ferromagnetic material can cover all or substantially all of the exterior surface 116 of the sink basin 102 and/or underside of the rim 104. By utilizing a non-magnetized ferromagnetic material instead of a magnet attached to the sink, inadvertent attachment of ferromagnetic objects to the sink is avoided.

Figure 6:
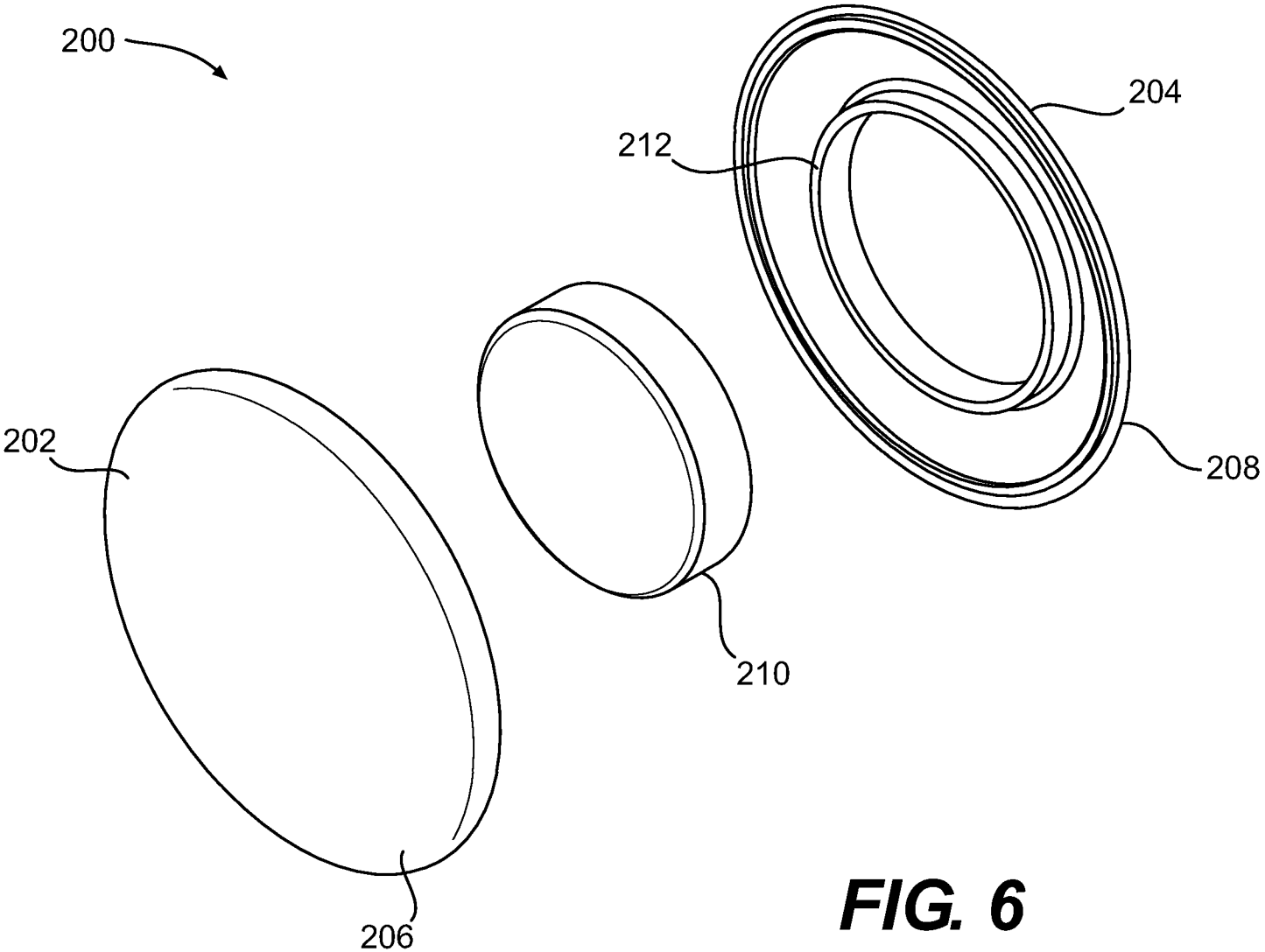
FIG. 6 is an exploded perspective view of the magnetic accessory attachment device of FIG. 3.

Turning to FIGS. 3-6, a magnetic accessory attachment device 200 is shown. The device 200 can be any suitable shape and size. For example, in the embodiment shown in the figures, the device 200 can be generally disc-shaped with contoured major surfaces 202, 204. It will be appreciated that the major surfaces 202, 204 can be any suitable shape, such as convex. The device 200 can be formed of one or more pieces. For example, as shown in FIG. 6, the device 200 can have two pieces 206, 208 that can be connected together in any suitable manner to form an encasement or body 214. A magnet 210 of any suitable shape, size, and magnetic strength may be disposed within the device 200. To restrict movement of the magnet 210 within the device 200, one or more of the interior facing surfaces of the device 200 can include an annular wall 212 extending therefrom. The magnet 210 can fit within the wall 212 such that the wall 212 at least partially surrounds the magnet 210 when the pieces 206, 208 of the device 200 are assembled. The pieces 206, 208 can be made of any suitable material.

The magnet 210 disposed within the device 200 permits the device 200 to magnetically attach to the sink 100 if the sink is ferromagnetic or to the ferromagnetic material 112 behind the sink 100 if the sink 100 is not ferromagnetic. In the latter configuration, the device 200 has the appearance from a user's perspective of being attracted to the sink, but instead, the device 200 is retained against the interior surface 114 of the basin 102 due to the attractive force, which passes through the basin 102, between the device 200 and the ferromagnetic material 112.

The contoured shapes of the major surfaces 202, 204 permit the device 200 to contact the sink 100 at only a portion of one of the major surfaces 202, 204. Due to the high strength of magnet used, the contoured shape reduces the possibility of pinching a user's fingers with the device 200. In addition, the contoured shape of the device 200 causes the major surface of the device in contact with the sink 100 to move away from the point of contact with the sink 100 and provide a finger-hold on the device 200 in the space between the device 200 and the sink 100 to assist with removal of the device 200.

The device 200 can be shaped to provide a universal attachment feature useable with any number of suitable accessories. An accessory may be made of a non-magnetized ferromagnetic material or have a non-magnetized ferromagnetic portion suitably shaped to mate with the device 200. More specifically, either or both major surfaces 202, 204 can be shaped to mate with the accessory, and the accessory can have an attachment portion, described further below, shaped to mate with the device 200. Accordingly, the shape of the attachment portion can operate as a locator for receiving the device 200 in a desired position and/or orientation on the accessory. The accessory can be indirectly attached to a sink with the device 200.

The ability to separate the device 200 from the accessories permits both the device and the accessories to be easily cleaned. In addition, the use of the device 200 as an intermediary attachment mechanism permits the accessories to be manufactured more efficiently, at a faster rate, at a lower cost, and at a lighter weight because a magnet is not incorporated into each of the accessories. In addition, because the accessories can be made to include a non-magnetized ferromagnetic material, the accessories can be stored without inadvertent attachment to other non-magnetized ferromagnetic objects, such as in a drawer or cabinet.

Examples of suitable accessories are shown in FIGS. 7-22 and further described below. However, it will be appreciated that any suitable accessory can be coupled to the device 200 for magnetic attachment via the device 200 to a sink 100.

Figure 7:
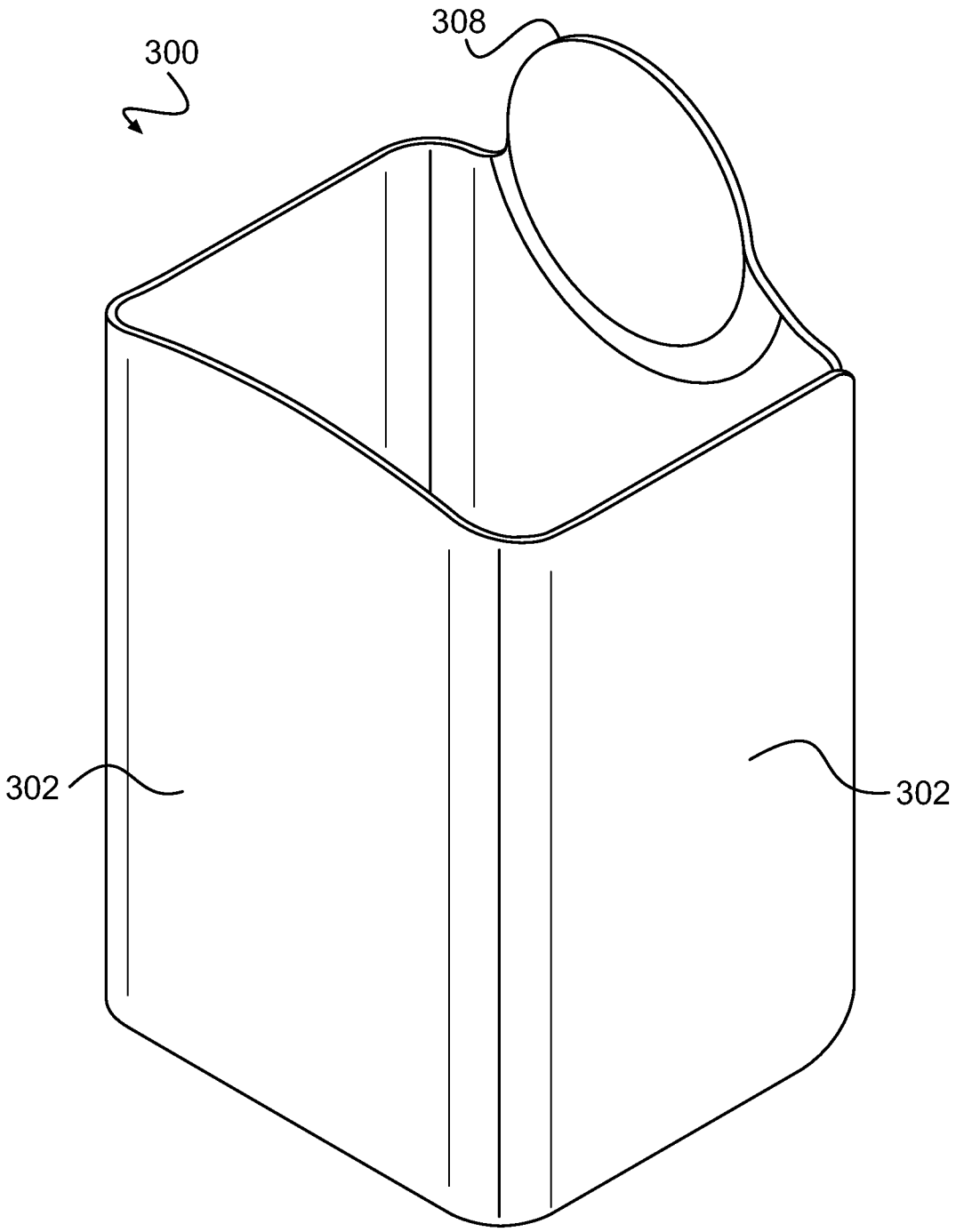
FIG. 7 is a perspective view of an accessory for use with the magnetic accessory attachment device of FIG. 3 embodied as a cup.
Figure 8:
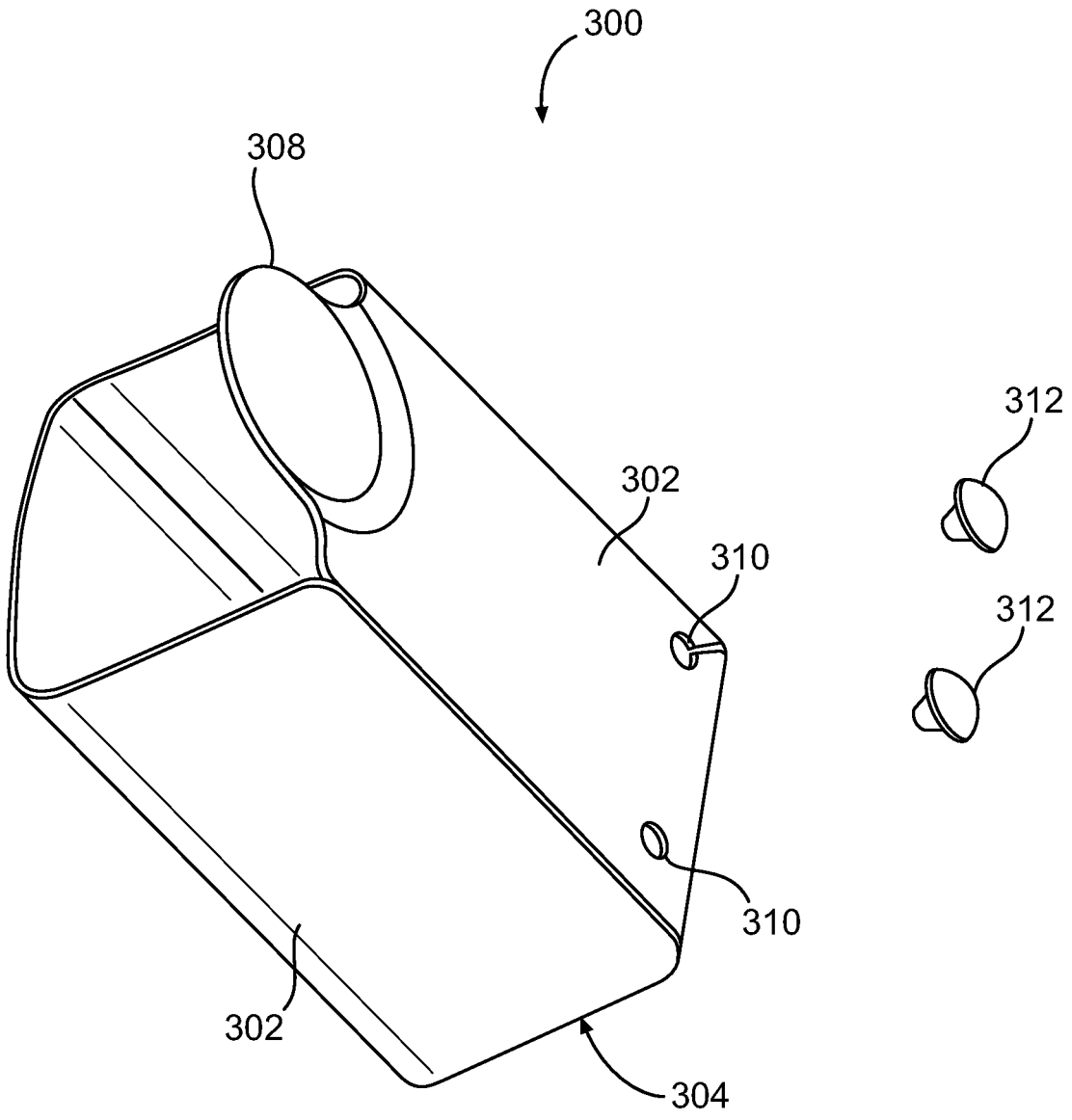
FIG. 8 is an exploded perspective view of the accessory of FIG. 7.
Figure 9:
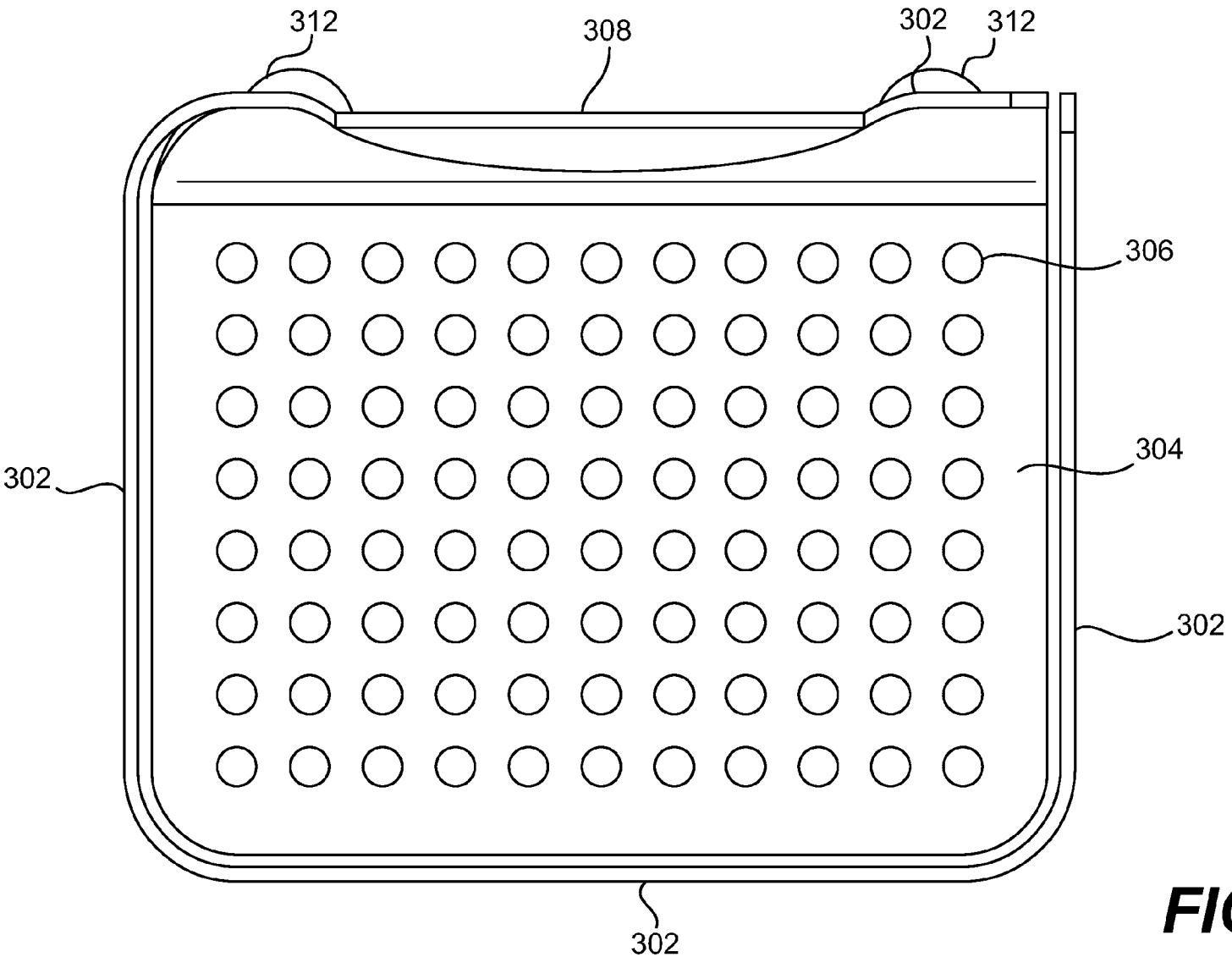
FIG. 9 is a top plan view of the accessory of FIG. 7.
Figure 10:
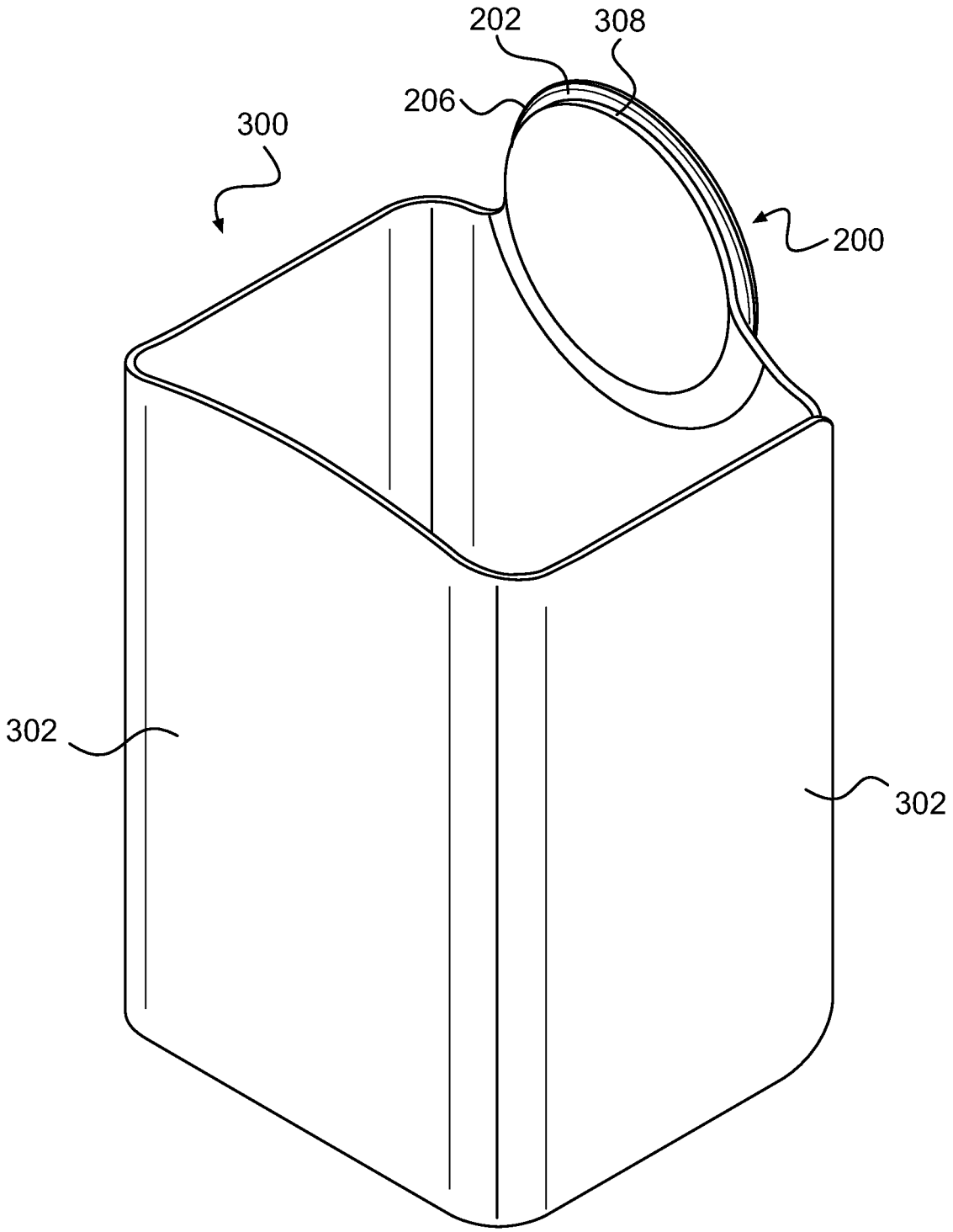
FIG. 10 is a perspective view of the accessory of FIG. 7 attached to the magnetic accessory attachment device of FIG. 3.
Figure 11:
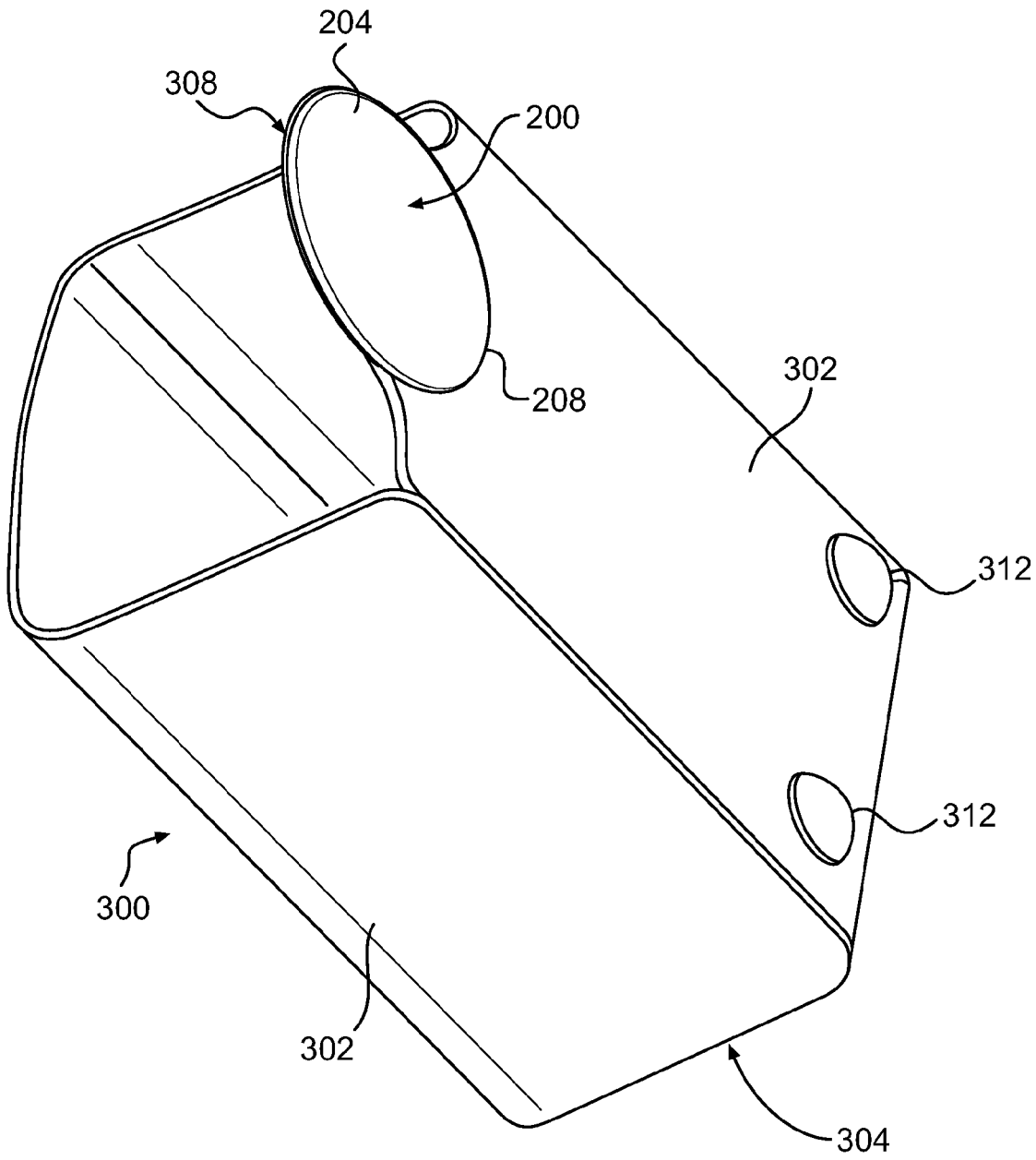
FIG. 11 is another perspective view of the accessory of FIG. 7 attached to the magnetic accessory attachment device of FIG. 3.

FIGS. 7-9 show an accessory in the form of a cup 300. The cup 300 includes sidewalls 302 and a base 304. The base 304 can include a plurality of apertures 306 to permit water to drain through the cup 300. The cup 300 may be used to hold objects such as silverware or cleaning brushes. The cup 300 can include an attachment portion 308 constructed with a non-magnetized ferromagnetic material. The attachment portion 308 can be shaped to receive the device 200. In this embodiment, as shown in FIGS. 10 and 11, the attachment portion 308 can be concave to receive a convex major surface 202 of the device 200. The magnet 210 within the device 200 magnetically attaches the device 200 to the ferromagnetic material of the attachment portion 308.

Figure 12:
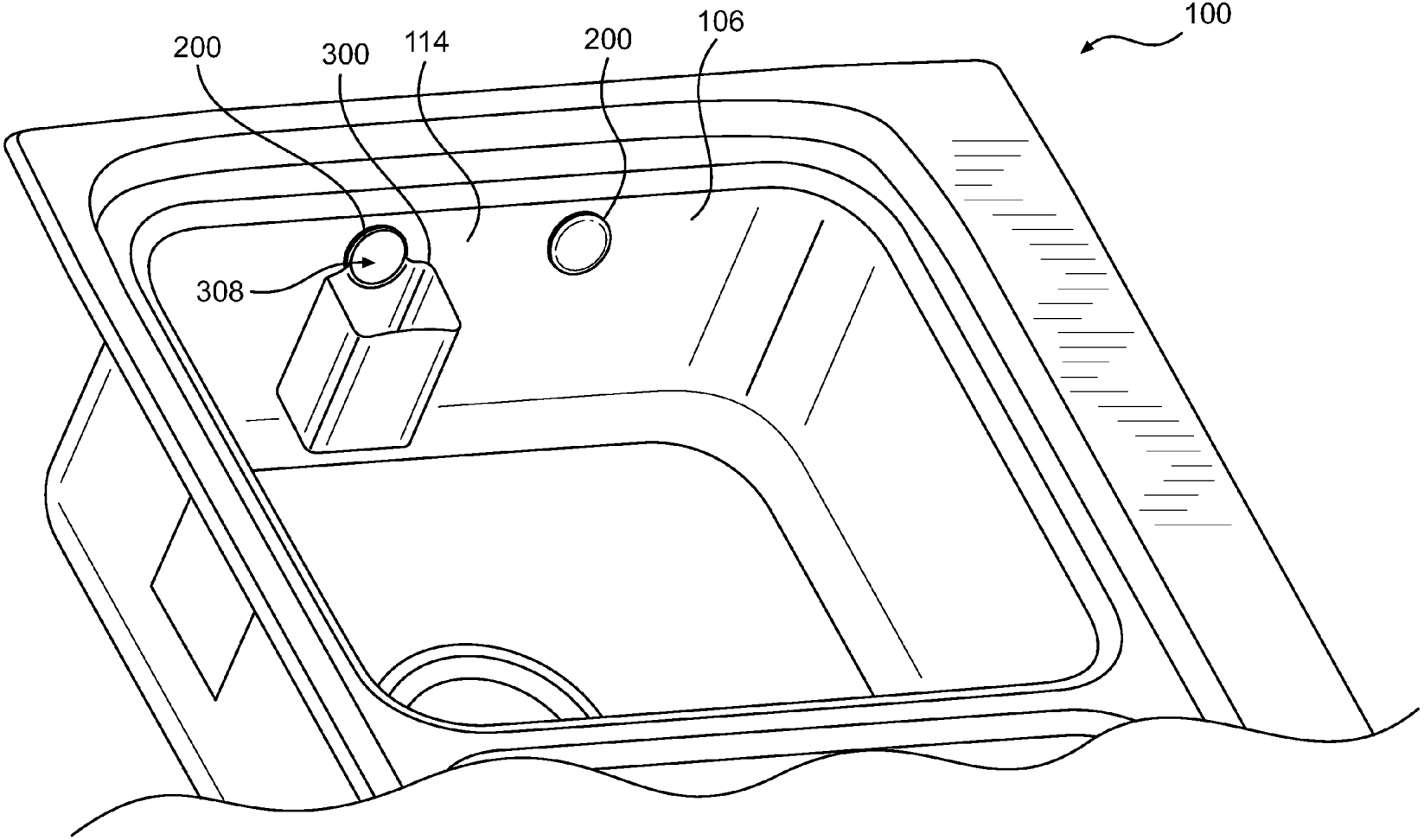
FIG. 12 is a fragmentary perspective view of the magnetic accessory attachment device of FIG. 3 and the accessory of FIG. 7 attached to the sink of FIG. 1.
Figure 13:
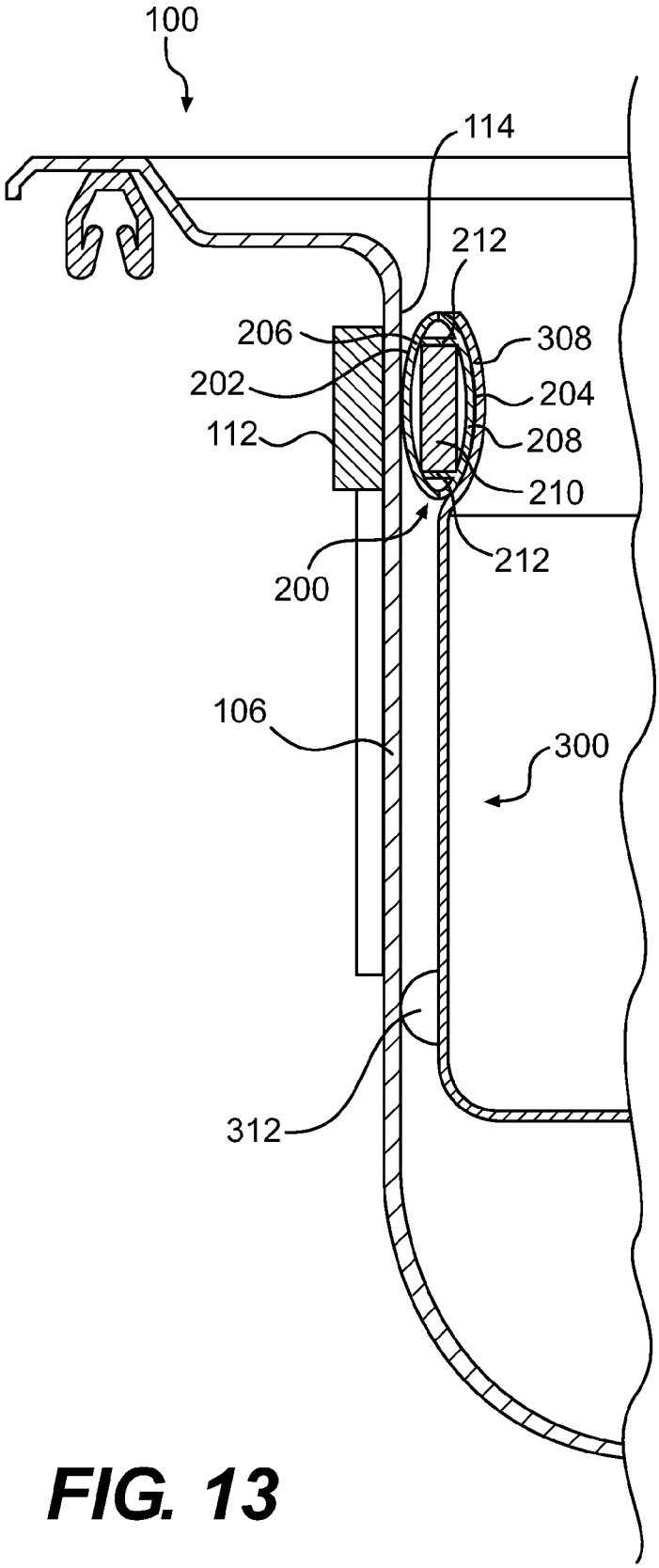
FIG. 13 is a fragmentary section view of the magnetic accessory attachment device of FIG. 3 and the accessory of FIG. 7 attached to the sink of FIG. 1.

As shown in FIGS. 12 and 13, once the device 200 is attached to the accessory, the device 200 can be magnetically attached to the interior surface 114 of the sink basin 102 to retain the accessory to the sink basin 102. Of course, it will also be appreciated that the device 200 can be attached to the sink 100 by itself as shown in FIG. 12 prior to attachment of an accessory or for storage when not in use with an accessory.

Referring again to FIGS. 8 and 11, the cup 300 can include one or more openings 310 to receive pins 312. The pins 312 can space the edge of the cup 300 from the sidewall 106 of the sink 100 to make the cup 300 generally parallel to the sidewall 106 and to avoid direct contact between the cup 300 and the sink 100, which might scratch the sink 100. The pins 312 can be rubber or another suitably soft material to avoid scratching the sink 100. The pins 312 can also provide a frictional force against the sidewall 106 to increase the weight capacity of the of the cup 300.

Figure 14:
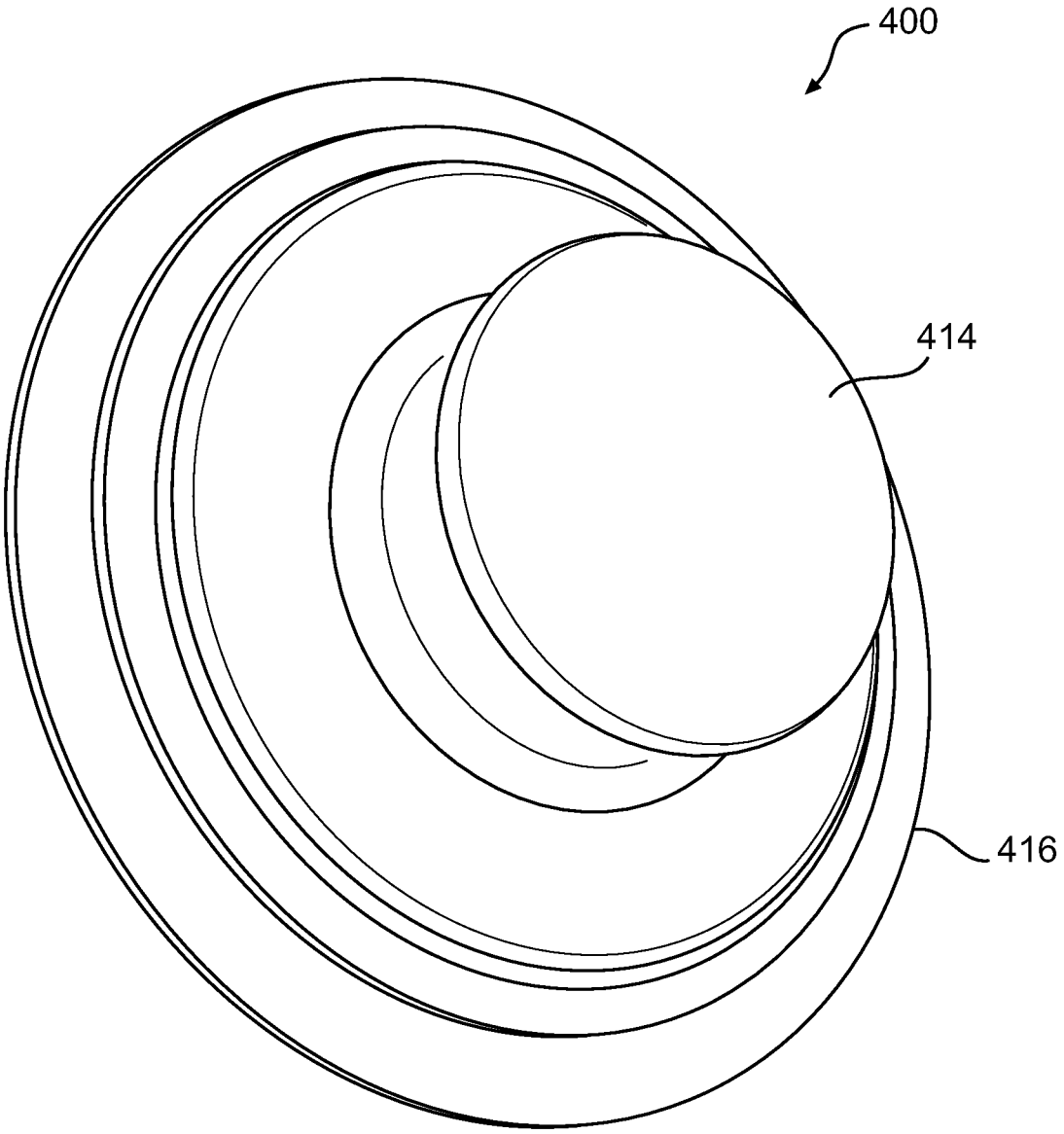
FIG. 14 is a perspective view of an accessory for use with the magnetic accessory attachment device of FIG. 3 embodied as a drain stopper.
Figure 15:
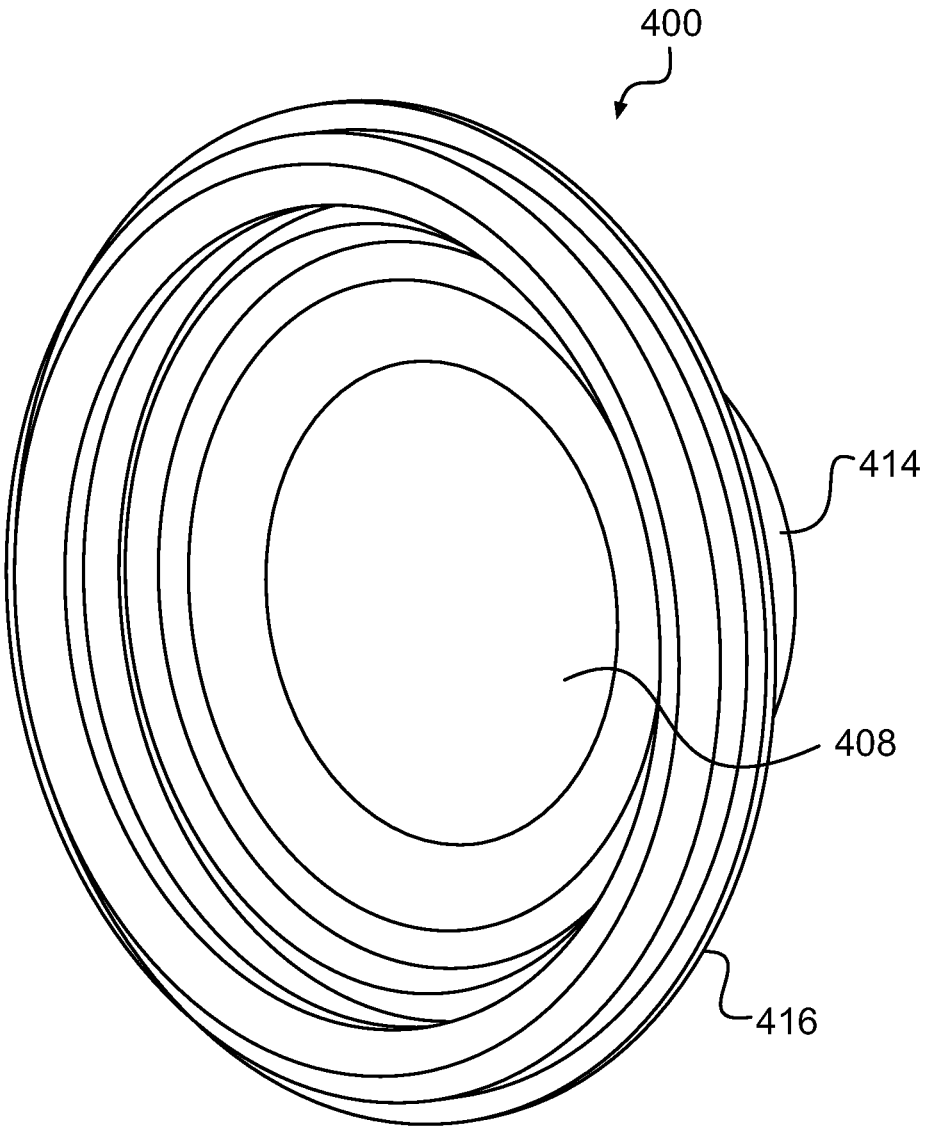
FIG. 15 is another perspective view of the accessory of FIG. 14.
Figure 16:
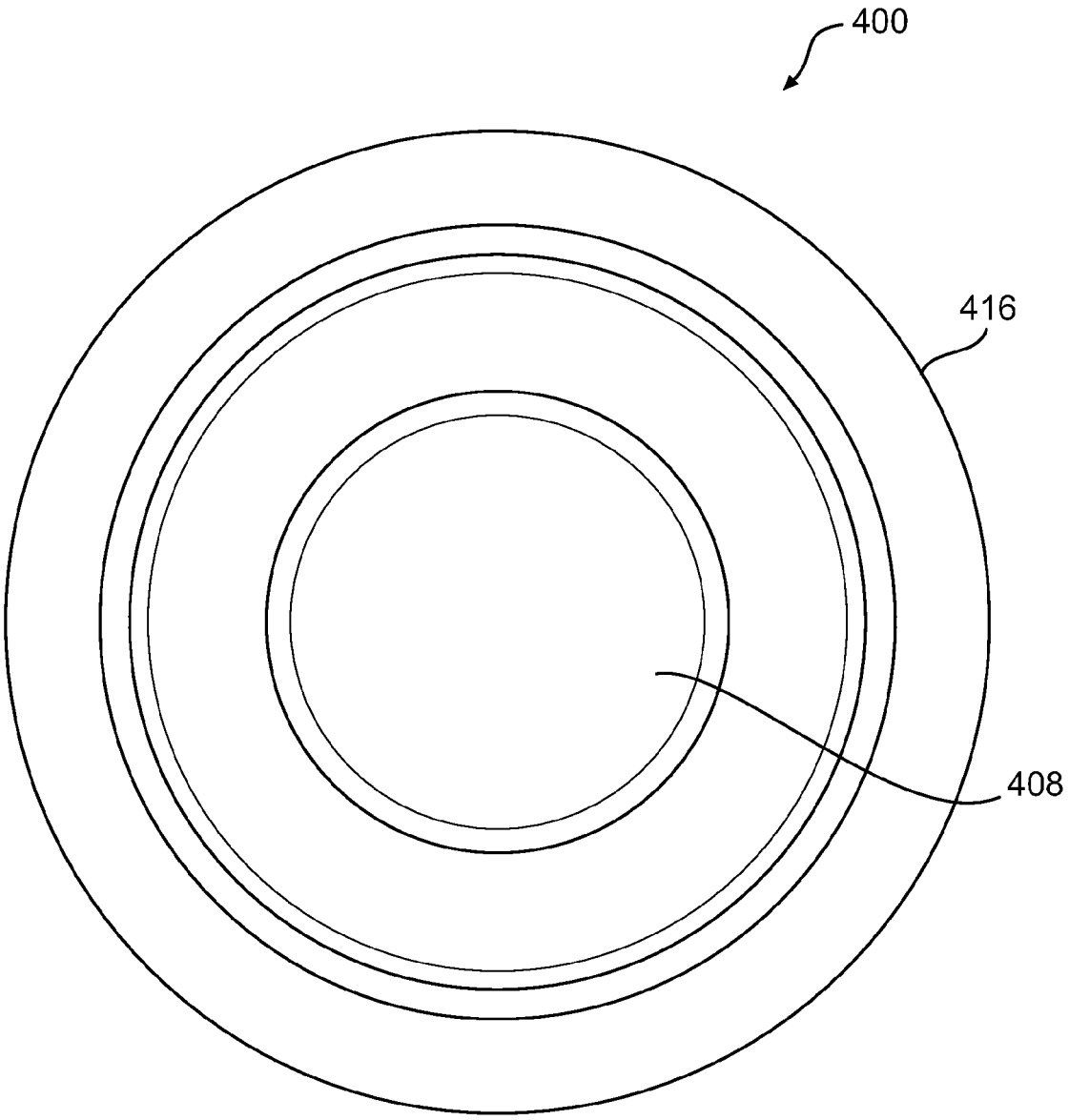
FIG. 16 is a bottom plan view of the accessory of FIG. 14.

FIGS. 14-16 show an accessory in the form of a drain stopper 400. The stopper 400 can be used to cover the drain and prevent water from draining out of the sink 100. The stopper 400 can include a knob 414 for gripping the stopper 400 and a seal 416 around a perimeter of the stopper 400. The seal 416 can prevent the flow of water past the stopper 400 such that a body of water can be retained in the sink basin 106 without draining. FIGS. 15 and 16 show an underside of the stopper 400, which can include an attachment portion 408 constructed with a non-magnetized ferromagnetic material. The attachment portion 408 can be shaped to receive the device 200. In this embodiment, the attachment portion 408 can be concave to receive a convex major surface of the device 200. The magnet 210 within the device 200 magnetically attaches the device 200 to the ferromagnetic material of the attachment portion 408. Once the device 200 is attached to the accessory, the device 200 can be magnetically attached to the interior surface 114 of the sink basin 102 to retain the accessory to the sink basin 102. The knob 414 can be oriented toward the sink, or alternatively, the seal 416 can be oriented toward the sink to avoid scratching the sink. In either arrangement, the device 200 is in contact with the drain stopper 400, but not in contact with the sink.

Figure 17:
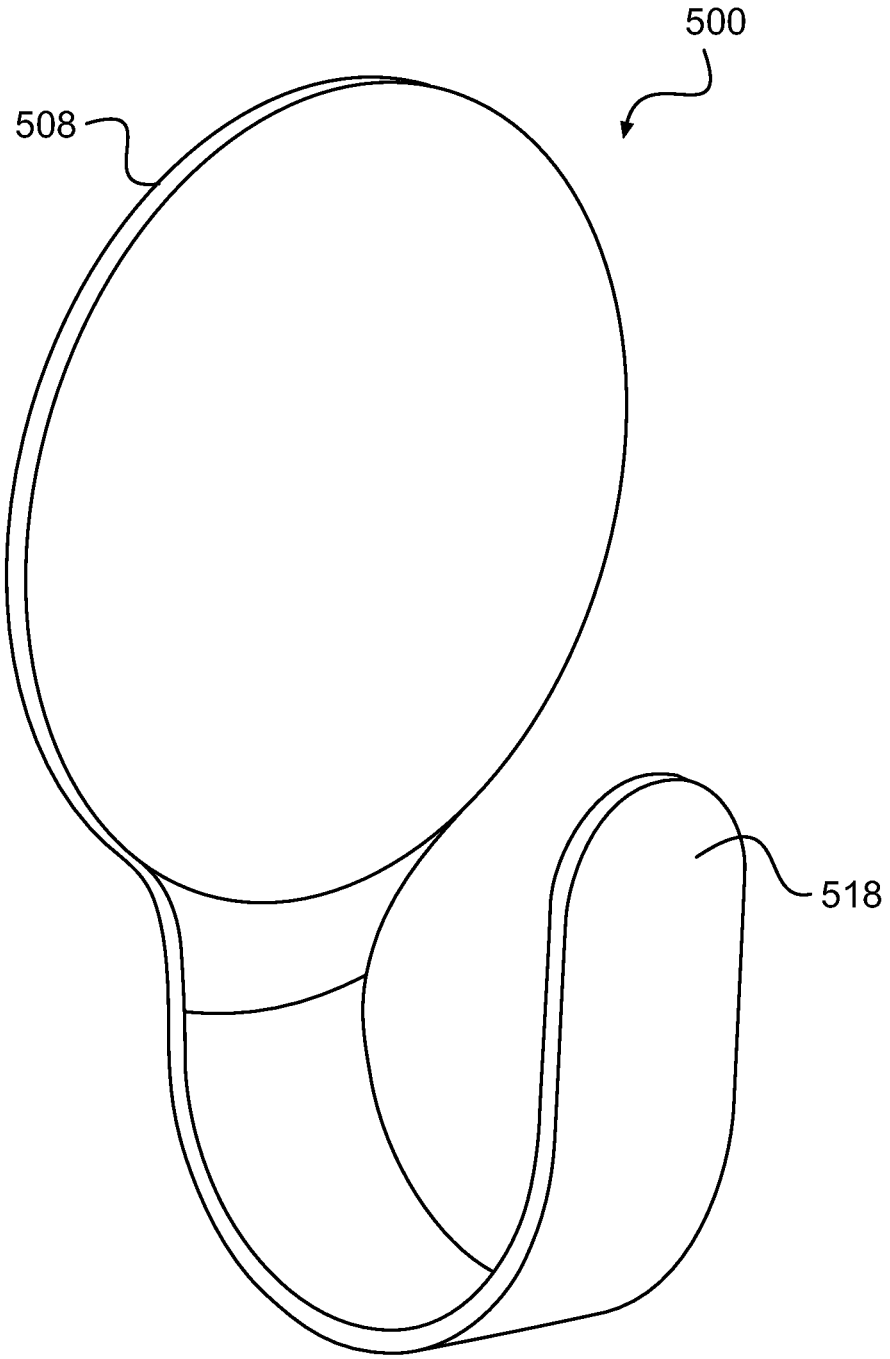
FIG. 17 is a perspective view of an accessory for use with the magnetic accessory attachment device of FIG. 3 embodied as a hook.
Figure 18:
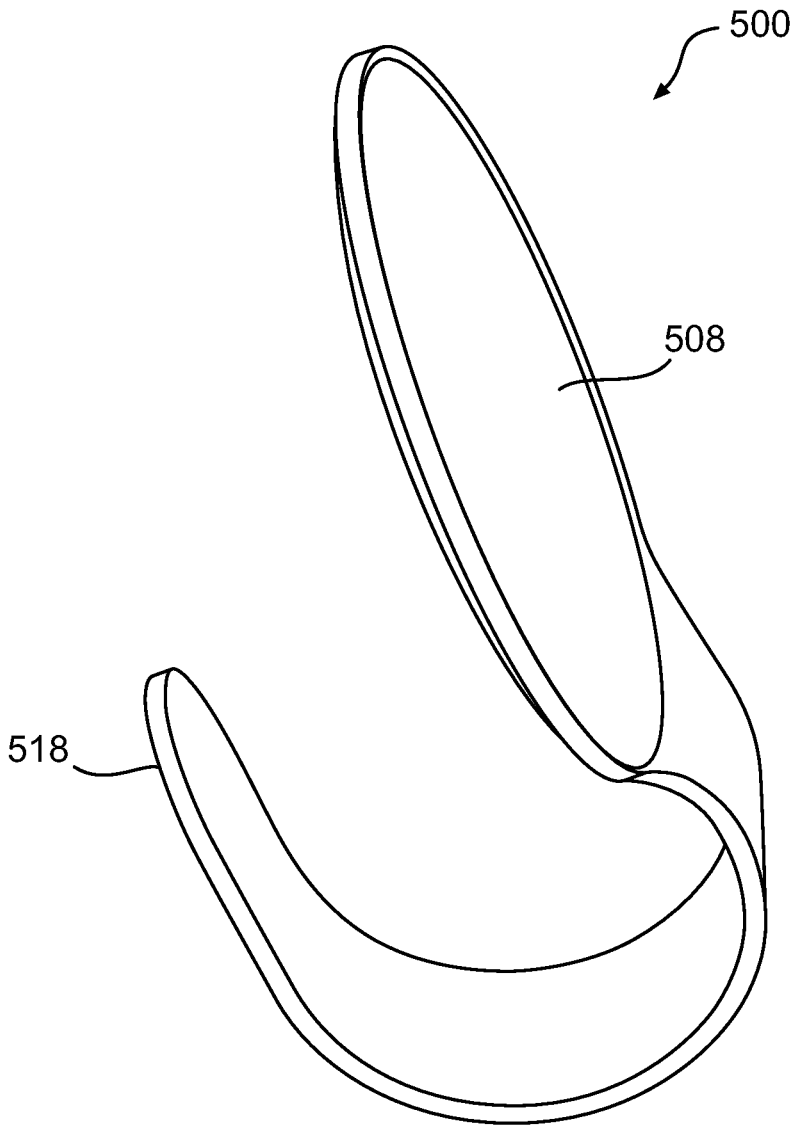
FIG. 18 is another perspective view of the accessory of FIG. 17.

FIGS. 17 and 18 show an accessory in the form of a hook 500. The hook 500 can include a finger 518 for hanging an object. The hook 500 can include an attachment portion 508 constructed with a non-magnetized ferromagnetic material. The attachment portion 508 can be shaped to receive the device 200. In this embodiment, the attachment portion 508 can be concave to receive a convex major surface of the device 200. The magnet 210 within the device 200 magnetically attaches the device 200 to the ferromagnetic material of the attachment portion 508. When the device 200 is attached to the accessory, the device 200 can be magnetically attached to the interior surface 114 of the sink basin 102 to retain the accessory to the sink basin 102.

Figure 19:
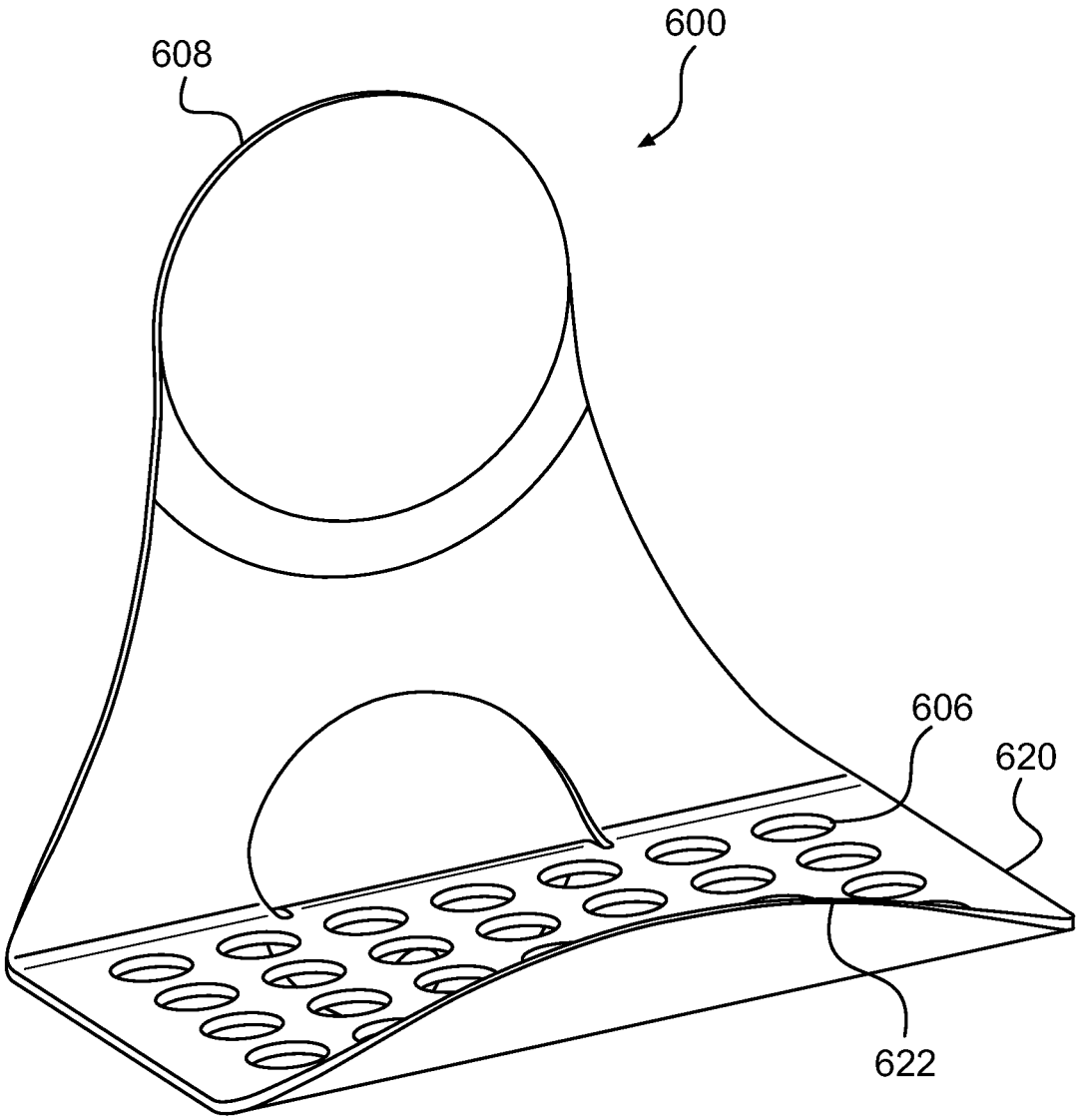
FIG. 19 is a perspective view of an accessory for use with the magnetic accessory attachment device of FIG. 3 embodied as a small shelf.
Figure 20:
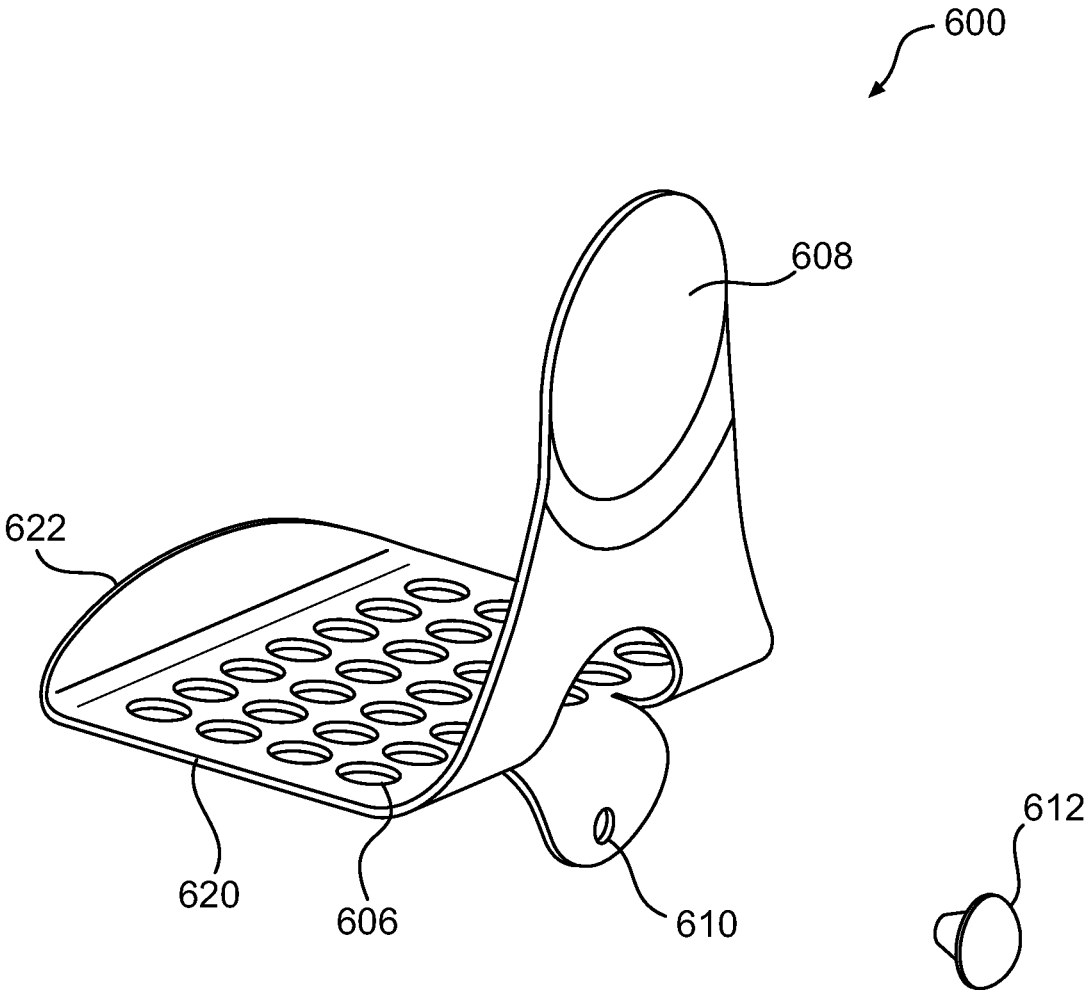
FIG. 20 is an exploded perspective view of the accessory of FIG. 19.

FIGS. 19 and 20 show an accessory in the form of a small shelf 600 for a bar of soap or other suitable object. The shelf 600 can include a platform 620 for supporting a bar of soap or other object. The platform 620 can include a plurality of apertures 606 to permit water to drain therethrough. The platform 620 can have a raised lip 622 to prevent an object from sliding off the platform at the lip 622. The shelf 600 can include an attachment portion 608 constructed with a non-magnetized ferromagnetic material. The attachment portion 608 can be shaped to receive the device 200. In this embodiment, the attachment portion 608 can be concave to receive a convex major surface of the device 200. The magnet 210 within the device 200 magnetically attaches the device to the ferromagnetic material of the attachment portion 608. When the device 200 is attached to the accessory, the device 200 can be magnetically attached to the interior surface 114 of the sink basin 102 to retain the accessory to the sink basin 102. The shelf 600 can include one or more openings 610 to receive one or more pins 612. The pin 612 can space the edge of the shelf 600 from the sidewall 106 of the sink 100 to make the shelf 600 generally parallel to the sidewall 106 and to avoid direct contact between the shelf 600 and the sink 100, which might scratch the sink 100. The pin 612 can be rubber or another suitably soft material to avoid scratching the sink 100. The pin 612 can also provide a frictional force against the sidewall 106 to increase the weight capacity of the shelf 600.

Figure 21:
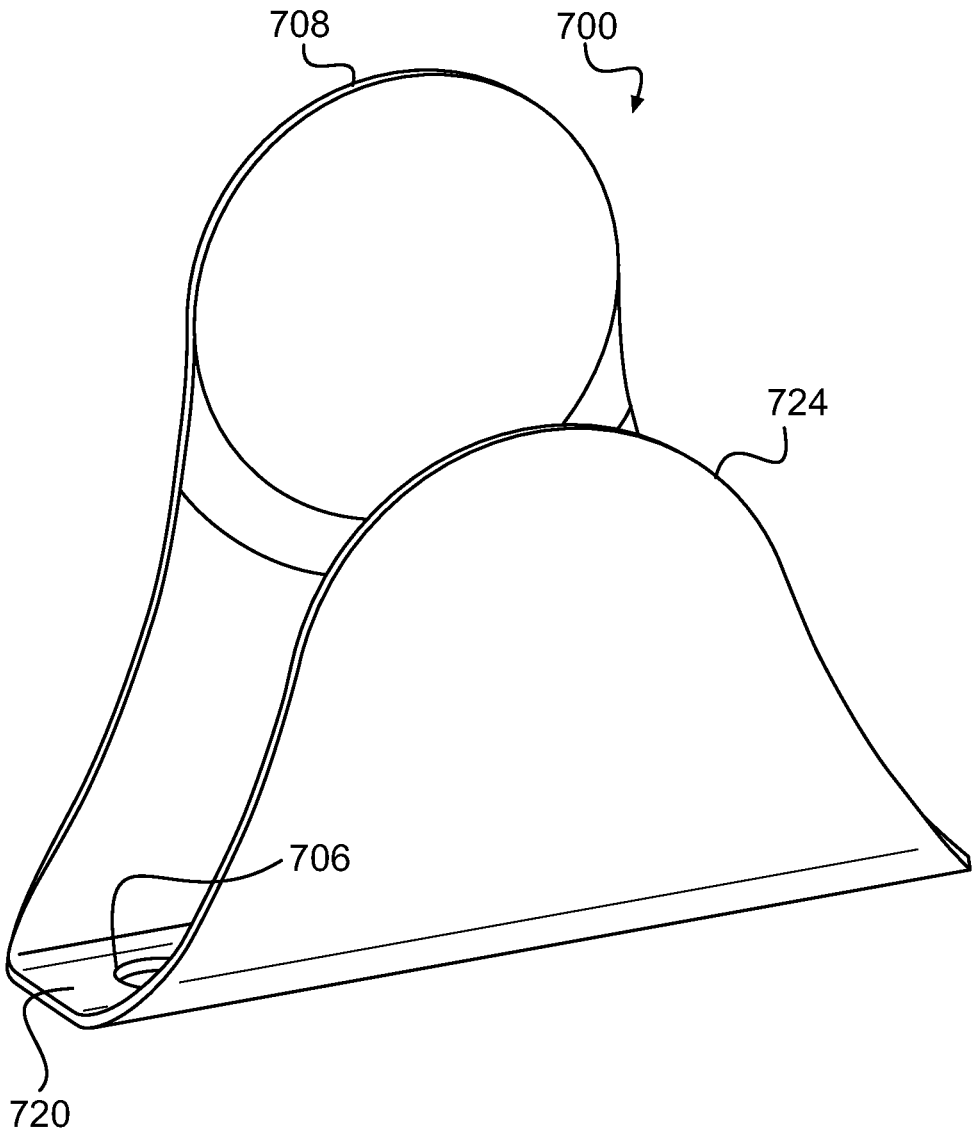
FIG. 21 is a perspective view of an accessory for use with the magnetic accessory attachment device of FIG. 3 embodied as a sponge holder.
Figure 22:
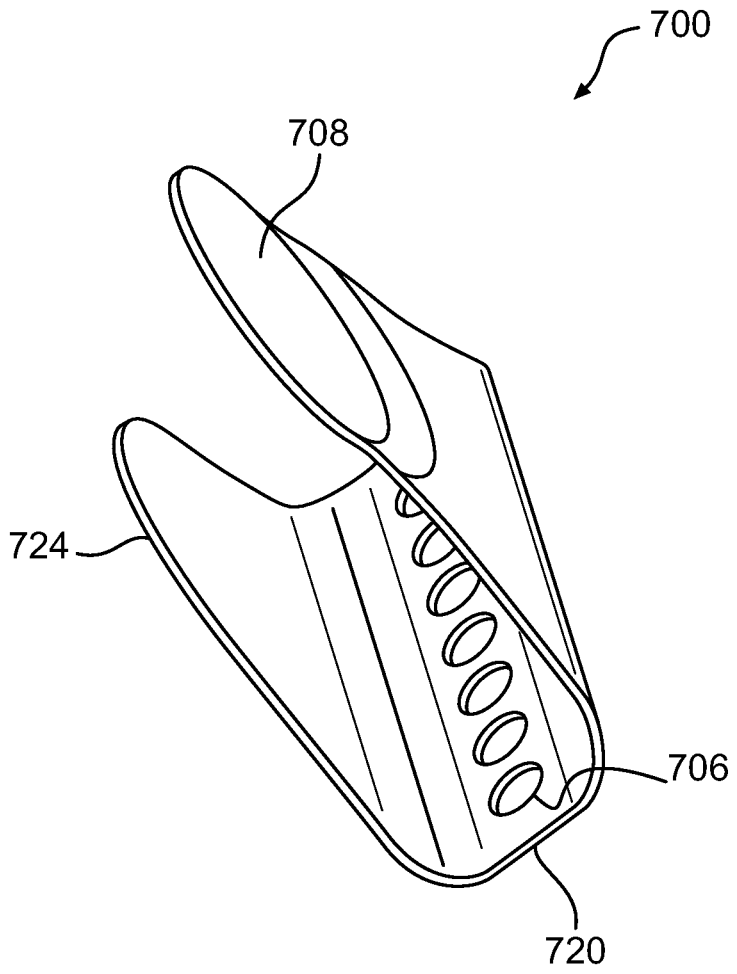
FIG. 22 is another perspective view of the accessory of FIG. 21.

FIGS. 21 and 22 show an accessory in the form of a holder 700 for a sponge or other suitable object. The holder 700 can include a platform 720 and an extended wall 724. The platform 720 can include a plurality of apertures 706 to permit water to drain therethrough. The wall 724 can project in a generally perpendicular direction from the platform 720. The holder 700 can include an attachment portion 708 constructed with a non-magnetized ferromagnetic material. The attachment portion 708 can be shaped to receive the device 200. In this embodiment, the attachment portion 708 can be concave to receive a convex major surface of the device 200. The magnet 210 within the device 200 magnetically attaches the device 200 to the ferromagnetic material of the attachment portion 708. When the device 200 is attached to the accessory, the device 200 can be magnetically attached to the interior surface 114 of the sink basin 102 to retain the accessory to the sink basin 102.

Each accessory can be constructed of any suitable material or combination of materials such that at least a portion of the accessory has a non-magnetized ferromagnetic material that can be magnetically attracted to the magnetic accessory attachment device containing a magnet. In this way, although each accessory may not by itself be attachable to a sink, the use of the magnetic accessory attachment device as an intermediary permits interchangeable use of accessories with the magnetic accessory attachment device to attach the accessories to a sink.

Although the device has been described for use with respect to a sink, it will be appreciated that the device could be utilized in other suitable applications such as bath tubs, wash basins, showers, appliances, etc.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A magnetic accessory attachment device for attaching an accessory having a non-magnetized ferromagnetic material to a sink having a non-magnetized ferromagnetic material comprising:

a body having a first external surface and a second external surface, at least one of the first and second external surfaces being adapted to contact the sink, and at least one of the first and second external surfaces being adapted to contact the accessory;

a magnet disposed within the body such that when the body is placed near the non-magnetized ferromagnetic material of the accessory, the magnet draws at least one of the first and second external surfaces against the accessory to removeably attach the magnetic accessory attachment device to the accessory, and such that when the body is disposed near the non-magnetized ferromagnetic material of the sink, the magnet draws the other of the at least one of the first and second external surfaces against the sink to removeably attach the magnetic accessory attachment device to the sink;

an accessory having a non-magnetized ferromagnetic material, the magnet being attracted to the non-magnetized ferromagnetic material to removeably attach the accessory to the body, wherein the accessory has an attachment portion shaped to mate with the body, the non-magnetized ferromagnetic material being disposed at the attachment portion.

2. The magnetic accessory attachment device of claim 1 wherein the body is generally disc shaped.

3. The magnetic accessory attachment device of claim 1 wherein at least one of the first external surface and the second external surface is convex.

4. The magnetic accessory attachment device of claim 1 wherein the body has a first piece and a second piece that are attached to one another to enclose the magnet.

5. The magnetic accessory attachment device of claim 4 wherein at least one of the first piece and the second piece includes an annular wall for receiving and at least partially surrounding the magnet.

6. The magnetic accessory attachment device of claim 1 wherein the accessory is selected from the group consisting of a cup, a drain stopper, a hook, a shelf, and a sponge holder.

7. The magnetic accessory attachment device of claim 1 wherein the attachment portion is concave, and at least one of the first external surface and the second external surface is convex to mate with the concave attachment portion.

8. A method of attaching an accessory having a non-magnetized ferromagnetic material to a sink having a non-magnetized ferromagnetic material, the method comprising:

providing a magnetic accessory attachment device having a body and magnetic properties;

placing the magnetic accessory attachment device in proximity to the non-magnetized ferromagnetic material of the accessory such that the magnetic accessory attachment device is removeably attached to the accessory; and placing the magnetic accessory attachment device in proximity to the non-magnetized ferromagnetic material of the sink such that the magnetic accessory attachment device is removeably attached to the sink, wherein the accessory has an attachment portion shaped to mate with the body, the non magnetized ferromagnetic material of the accessory being disposed at the attachment portion.

9. The method of claim 8 wherein the body is generally disc shaped.

10. The method of claim 8 wherein the body has a first external surface and a second external surface, and at least one of the first external surface and the second external surface is convex.

11. The method of claim 8 wherein the body has a first piece and a second piece that are attached to one another to enclose a magnet.

12. The method of claim 11 wherein at least one of the first piece and the second piece includes an annular wall for receiving and at least partially surrounding the magnet.

13. The method of claim 8 wherein the accessory is selected from the group consisting of a cup, a drain stopper, a hook, a shelf, and a sponge holder.

14. The method of claim 8 wherein the attachment portion is concave and the body has a first external surface and a second external surface, and wherein at least one of the first external surface and the second external surface is convex to mate with the concave attachment portion.

15. The method of claim 8 wherein the accessory is made with the non-magnetized ferromagnetic material of the sink.

16. The method of claim 8 wherein the sink is made with the non-magnetized ferromagnetic material of the accessory.

17. The method of claim 8 wherein the non-magnetized material of the sink is adhered to a backside surface of the sink.

18. The method of claim 8 wherein the accessory is a drain stopper, and wherein the magnetic accessory attachment device is removeably attached to the drain stopper such that the magnetic accessory attachment device does not contact the sink when the magnetic accessory attachment device is removeably attached to the sink.

* * * * *